United States Patent [19]

Easterday

[11] Patent Number: 4,457,023

[45] Date of Patent: Jul. 3, 1984

[54] BOXING GLOVE WITH THUMB TIE DOWN

[75] Inventor: Arthur M. Easterday, Sidney, Nebr.

[73] Assignee: Safe Play Manufacturing Co., Inc., Sidney, Nebr.

[21] Appl. No.: 393,465

[22] Filed: Jun. 29, 1982

[51] Int. Cl.[3] ..... A41D 13/10

[52] U.S. Cl. ..... 2/18; 2/161 A

[58] Field of Search ..... 2/18, 2, 20, 158, 161 A

[56] References Cited

U.S. PATENT DOCUMENTS

| | | | |
|---|---|---|---|
| 705,915 | 7/1902 | Gamble | 2/18 |
| 1,453,715 | 5/1923 | Levinson | 2/18 |
| 1,534,906 | 4/1925 | Bridgewater | 2/18 |
| 2,056,326 | 10/1936 | Orsini | 2/18 |
| 2,416,444 | 2/1947 | Hilton | 2/18 |
| 3,663,960 | 5/1972 | Kennedy | 2/18 |

*Primary Examiner*—Henry Jaudon
*Assistant Examiner*—Tracy Graveline
*Attorney, Agent, or Firm*—Eugene E. Renz, Jr.

[57] ABSTRACT

A boxing glove with thumb tie down has been provided which incorporates a connecting bridge which holds the thumb in essentially a closed or nested position at all times. The connecting bridge extends from the upper edge of the thumb sheath to the thumb guard location as a controlled thumb feature. The connecting bridge provides limited mobility of the thumb to prevent thumbing and eye injuries. The improved boxing glove maintains the thumb sheath in a tight position to prevent causing injuries such as gouging, yet permits the confined hand to relax at the boxer's discretion.

1 Claim, 6 Drawing Figures

BOXING GLOVE WITH THUMB TIE DOWN

BACKGROUND OF THE INVENTION

The controversy between the conventional boxing glove and the new thumbless boxing glove has become a burning issue in recent months. Consequently, there is obviously a need in the art to improve on the standard glove used by boxers for many decades. The thumbless glove as an answer remains to be seen.

The conventional boxing glove used in the past consists of a heavily padded leather mitten for confining the fingers of the hand and a separate thumb sheath, equally padded for the thumb. The boxer, during a match, clenches his fingers in the form of a fist in the glove to the center of the palm and closes the thumb sheath over the index finger. In this position, the thumb guard, which forms a rise in the glove nearest the knuckle of the index finger, the thumb sheath and the glove body combine to form a continuous, rounded fist. Punches are most often thrown with the glove clenched in this manner. However, between the thrown punches, the boxer can still relax his hand to some degree as a result of the flexible construction of the standard glove.

This flexible aspect of the conventional boxing glove has certain advantages as well as disadvantages. The advantages include the ability to open the fist at the boxer's discretion, a necessity for many boxing techniques. For example, clinching, a common boxing technique, occurs when two boxers grasp each other within a hold. The glove, in this situation is held slightly open to facilitate holding on to the other boxer. Open glove blocking also requires the glove to be held in an open manner in order to absorb an opponent's punch. Even something as simple as holding the ropes requires the glove to be slightly opened for added gripping power. As a result of the aforementioned flexibility, the standard boxing glove has been effective, a testimony to its design which remains in use today. This glove gives freedom of movement to the fingers and thumb of the hand, yet creates a tight fist for powerful punching.

The disadvantages, however, have become considerably more pronounced in the recent years. Boxers must train themselves to maintain their hands in a clenched fist for long periods of time, and specifically to train their thumbs to remain in a tucked position. This is difficult in certain situations. Specifically, situations where the boxer is punching or jabbing in the direction of his opponent's orbit and eye area. Often as the boxer aims for his opponent's eye and the glove establishes contact with the eye area, the portion of the glove making contact is the glove body, closest to the thumb sheath and the thumb sheath itself. The glove will either graze the eye and swing past, or due to the unrestrained thumb, gouge it. Gouging or thumbing causes serious injury. The thumb sheath, because it is separate and separable from the glove body, catches in the eye socket and pulls away from the glove body. This is unintentional on the puncher's part as no amount of training can discipline the boxer to hold the thumb and fingers together under increasing pressures. The impact and force of the punch causes the boxer to lose control and position of the thumb in the clenched fist shape of the glove. Detachment of the retina, as well as surface scratches, a result of gouging; may occur when a boxer inadvertently and improperly or intentionally uses his fist in this manner. Detachment of the retina causes the victim to experience flashes of light or impairment of vision and continued use of the eye could lead to further detachment and subsequent loss of vision. In other words, one punch could end a career and it is understandable why boxers have objected to the conventional glove.

One solution to this problem of the separating thumb has been the thumbless boxing glove. It appears, however, from several trial runs that the thumbless glove is a shortlived solution. The glove's disadvantages clearly outweigh its advantages and the boxers who have used the gloves are objecting more strenuously now than with the use of the conventional glove.

The thumbless glove is similar to the conventional glove as a padded mitten except that the thumb of the hand is completely confined in the glove body as a single integral unit. The thumb remains completely immobile during any part of the fight. The thumbless glove forces the entire hand to remain immobile and maintains the hand in a clenched rigid position at all times. Prior to use of the thumbless glove, the fingers and thumb are bandaged together rather than only the fingers bandaged as in the conventional glove. The glove is then laced on the hand in a similar fashion to the conventional glove.

Each state has its own athletic commission which sets the rules governing the various sports activities and competitions. The human body has become more machine like, due to increased improvements in training the athlete. Therefore, there is an increased need for safety which the Commissions oversee. At the beginning of 1982, the New York State Athletic Commission mandated the use of the new thumbless glove in all but World Championship fights in New York State starting January 15th, 1982 (now changed to May 15, 1982). This edict caused a great deal of commotion and resulted in the boxers flatly refusing to fight if they had to wear the thumbless glove. The Commission believes the thumbless glove to be safer and eliminate gouging and thumbing injuries. However, they have not taken into consideration the glove's strong drawbacks and disadvantages. It should also be recognized here that no other State Commission has mandated use of the thumbless glove to date.

The drawbacks of the thumbless glove are many. Considering the amount of time spent on training technique, the intricate footwork and mental discipline involved in becoming a boxer, the thumbless glove appears to be an extreme safety feature by eliminating the thumb sheath altogether. World Championship boxers have trained their entire lives and based their training and techniques on the conventional glove. The offensive and defensive tactics and balanced footwork were acquired in relation to the conventional glove. A boxer, early in his career, must learn to coordinate feet movements with the glove he is using and this talent stays with him throughout his career. To drastically change the glove structure as the thumbless glove has proposed would mean returning to basic training. In other words, boxers would have to restructure their boxing training from the beginning to accommodate the thumbless glove. This would be ludicrous for many world champions and one of the reasons for their strong opposition to the thumbless glove.

Before the boxer places a boxing glove on his hand, the hand must be bandaged according to specific regulations. A boxer's hands are wrapped by his trainer with gauze for protection. Before a fight, an official Glover will check their hands to make sure they are wrapped or bandaged according to the specifications for each tournament. Only a certain amount of gauze may be used and the hands must be wrapped in an approved fashion e.g. knuckles cannot be padded to give unfair advantage. Fighters are particular about how their hands are bandaged and who may do it . Bandaging a fighter's hand has become a superstitious ritual sustained by most boxers. Use of the thumbless glove requires a new proper way to bandage the hand to include the fingers and thumb unlike the conventional glove. Few people know or understand how to properly bandage the hand for use in the new glove. This could not only unnerve the fighter but shatter his training techniques which are accustomed to the previous bandaging. The boxer has been trained to fight in a certain way and throw punches with a hand bandaged in a certain manner. Again, the boxer will have to relearn the art of boxing, should the Commissions all mandate use of the thumbless glove.

In addition to the aforementioned disadvantages, boxers who have tested the glove, strongly oppose its use for many reasons. It is the contention of the fighters that the thumbless glove causes numbness in the hands and arms when used in more than a few rounds. Surely this is not an added safety feature. The fighters have also stated that use of the new glove, while preventing eye injuries, makes the confined thumb more susceptible to fracture. It is inconceivable that the Commission mandate use of the thumbless glove for safety reasons when the boxers experience numbness and damage to their own limbs. The Commission, eliminating one problem has created more serious ones.

A study on the thumbless glove conducted by Wayne State University exposed several interesting drawbacks in relation to the proclaimed safety of the new thumbless glove. It was discovered that use of the thumbless glove considerably decreases the effectiveness of the punching power. This can only mean that the fighter will deliver more blows to achieve a knockout than with the conventional glove. Could this be safer? Apparently the fighter must work harder and accumulate more damaging blows to his opponent than ever before.

Recapitulating, the thumbless glove may prevent thumbing and gouging injuries but creates added drawbacks from a safety standpoint. Moreover, the boxer using the glove must develop the special rhythm and body movement influenced by the specific glove the fighter trained with from the beginning of his career. The thumbless glove will drastically change the boxer's training, footwork, and hand movements. Even during clinching situations the boxer is unable to slightly open the thumbless glove for added leverage in a hold due to the rigid and restrained position of the hand in the glove. Furthermore, the boxer who learns to use the glove will be plagued with numbness of hands and arms not to mention possible broken thumb injuries.

The controversy remains between the conventional glove and the thumbless glove. The conventional glove causes frequent and serious eye injuries and the thumbless glove, as a solution, has gone too far to the extreme of the spectrum to be worthwhile. There is a need in the art for a combination of the advantages of the conventional glove and the advantages of the thumbless glove. Applicant proposes a glove which will not drastically change the fighter's training techniques and which will be safer and eliminate thumbing and gouging injuries.

SUMMARY OF THE INVENTION

Boxing gloves have been used and improved for many years prior to this invention. The conventional boxing glove used today has a serious flaw in that the thumb causes eye injuries due to its separate position from the glove body. The thumbless glove as an alternative has not proved successful for the many reasons stated above.

Accordingly, it is an object of the present invention to provide an improved and safer boxing glove with a thumb tie down which embodies the advantages of the conventional glove and the thumbless glove.

The glove of the present invention includes a heavily padded glove body for confining the fingers of the hand. The glove body contains an independent thumb sheath for the thumb of the hand. The glove body further includes a thumb guard, located between the knuckle and joint of the index finger which projects sideways from the glove body at the knuckle. Positioned between the upper edge of the thumb sheath and tucked under the thumb guard is a connecting bridge for holding the thumb in a closed position.

The connecting bridge is positioned such that the side surface of the thumb sheath, when the fist is clenched, rests beneath the projecting thumb guard. The tip of the thumb sheath rests on the inner surface of the glove body. In this position, only the padded portion of the thumb sheath is exposed and the glove becomes a continuous rounded fist. The thumb sheath is confined against the glove body where it will not catch and be pulled away from the glove body. The connecting bridge maintains the thumb sheath in this safe nestled position.

The improved boxing glove with thumb tie down of the present invention trains the boxer to hold his thumb in a nested but not rigid position. The thumb has limited mobility and is incapable of completely separating from the glove body. The connecting bridge spaces the glove body and the thumb sheath and attaches or ties the thumb to the glove body.

The connecting bridge is an improved safety feature of the boxing glove. The bridge disciplines the boxer to hold his thumb in a tight position. Use of the glove of the present invention reduces the danger of gouging or thumbing the eye by virtue of the bridge holding the thumb closer to the thumb body where it can do little damage.

The limited mobility provided by the glove will prevent holding with an open glove in clinch situations yet permits flexible movement of the hand for relaxing or pushing away. A further advantage includes the flexible and limited mobility of the hand unlike the rigid clenched fist conducive to the thumbless glove.

Another object of the present invention is to provide a boxing glove which will not change the training pattern or boxing techniques the fighters have already learned from using the conventional glove. The glove with the thumb tie down automatically compels the boxer to keep the thumb in the nested position without cramping and will not alter rhythm or footwork.

BRIEF DESCRIPTION OF THE DRAWINGS

FIG. 5 is a perspective view of the boxing glove in an open position.

DESCRIPTION OF PREFERRED EMBODIMENT

Figure 2A:
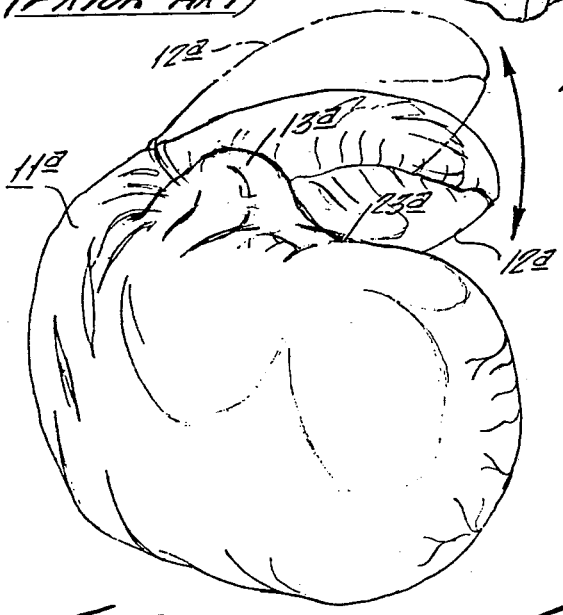
Fig. 2A. (PRIOR ART)
FIG. 2A is a front elevational view of the prior art conventional boxing glove showing the free mobility of the thumb.

The conventional boxing glove illustrated in FIG. 2*a* includes a padded glove body 11*a* and a thumb sheath 12*a*. The thumb guard 13*a* is located on the inner surface of the glove body 23*a*. FIG. 2*a* demonstrates the free mobility of the thumb sheath 12*a*. The thumb sheath swings in an arcuate path and is, therefore, capable of intentionally or unintentionally gouging or scratching an opponent's eye. The thumb sheath 12*a* extends well beyond and outside the thumb guard 13*a*. The boxer must physically restrain the thumb to avoid such injury. The thumb sheath 12*a* nestles against and above the glove body 11*a* when the fist is clenched, however, a small amount of pressure exerted against the thumb sheath 12*a* easily pulls it out of this position. Consequently, the thumb becomes free to gouge or jab the face and eyes of the opponent.

Figure 1:
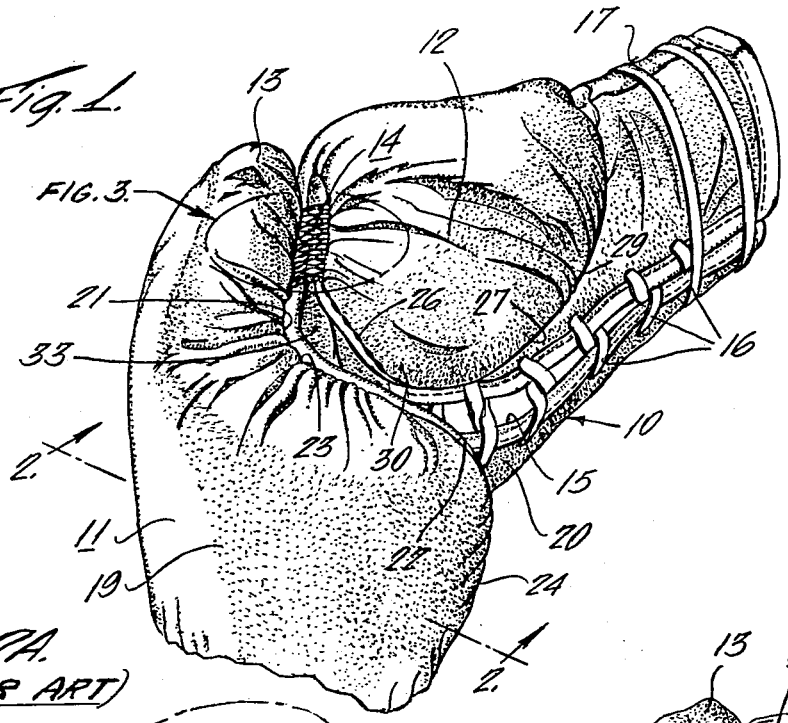
FIG. 1 is a perspective view of the boxing glove showing the connecting bridge.
Figure 2:
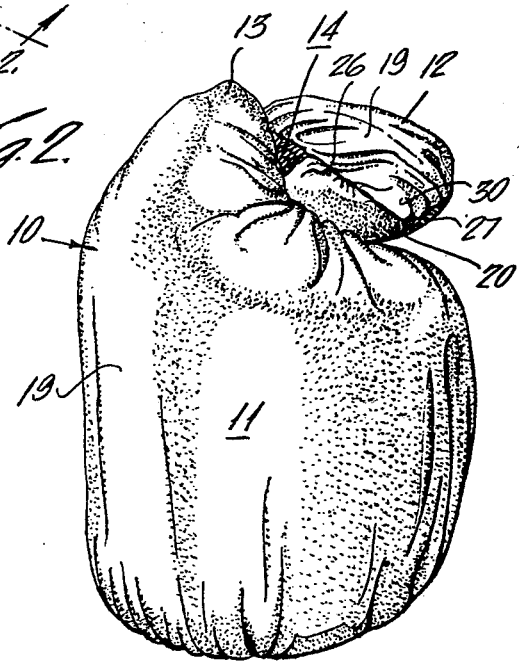
FIG. 2 is a front elevational view of the boxing glove showing the thumb nested against the glove body along lines 2—2 of FIG. 1.
Figure 3:
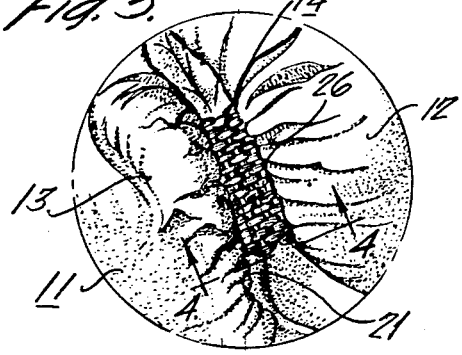
FIG. 3 is an enlarged fragmentary plane view of the connecting bridge shown within the dot and dash circle of FIG. 1 and designated FIG. 3.

As shown in FIG. 1, the boxing glove 10 of the present invention, structurally similar to the conventional glove, includes the glove body 11 for confining the four fingers of the hand. The thumb guard 13, an integral portion of the glove body 11, is located approximately between the second joint and the knuckle of the index finger and projects sideways from the knuckle. The thumb sheath 12 extends independently from the glove body 11. A connecting bridge 14, maintains the thumb sheath 12, in a closed or tucked position when the fist is clenched to form a rounded continuous fist as illustrated in FIG. 2. The boxing glove 10, further includes a slit 15 extending from the palm to the wrist secured by lacing 16 for easy adjustment when pulling the glove on or off.

The glove body 11 consists of an outer heavily padded shell 19 which extends and covers the back portion of the hand from the beginning of the wrist, over the tips of the fingers to approximately the first joint of the four fingers. This outer shell 19 meets an inner non-padded leather panel 20 which covers the inner remaining portion of the fingers and the palm of the hand. The outer edges of the padded shell and panel overlap and are turned inwardly to form a seam (21, 22) extending along the inner surface 23 of the glove body 11 below the thumb guard 13 to the outer surface of the glove body 24. The space between the shell 19 and panel 20 defines a pocket for the fingers of the hand (not shown in the drawings). The inner seam 21 and outer seam 22 meet approximately at a corresponding position to the first joint of the four fingers as shown in FIG. 5.

The thumb sheath is similarly constructed. The outer padded shell 19 extends over the back of the thumb to meet the non-padded panel 20 covering the palm and front of the thumb. The shell and panel of the thumb join at a seam (26, 27) which extends over the outside periphery of the thumb forming an inner seam 26 proximate the glove body 11 and an outer seam 27 running along the outer portion of the thumb 29 and thumb heel. The space between the outer shell 19 and inner panel 20 of the thumb defines a pocket for the thumb (not shown). With the glove body and thumb padded in this manner, the blows administered are softened to prevent serious injury. The back of the hand and thumb are completely padded as well as the tips of the fingers.

Figure 4:
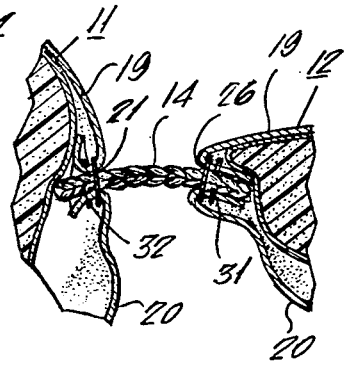
FIG. 4 is an enlarged fragmentary sectional view taken along the line 4—4 of FIG. 3 showing the connecting bridge and how it attaches to the glove body and the thumb sheath.

The connecting bridge 14, shown in FIGS. 1–4 secures the thumb sheath 12 to the glove body 11. The bridge 14 of generally rectangular shape, is inserted and sewn at one end 31 into the inner seam 26 of the thumb sheath 12 towards the upper end of the thumb 31 nearest the thumb nail and is sewn at its opposite end 32 into the inner seam 21 of the glove body 11 at the thumb guard location as shown in FIG. 2. FIG. 4 shows the ends of the bridge 31 and 32 recessed in the seam 26 between the inner panel 20 and outer shell 19 of the thumb and in the seam 21 between the inner panel 20 and outer shell 19 of the glove body. The ends of the bridge rest interiorly of the gloves shell and panel. Further injuries are prevented by confining these ends rather than having protruding edges that may cause facial scratches or damage to the opponent.

The location of the bridge 14, near the tip of thumb 30, permits the boxer to effortlessly hold the thumb close to the glove body 11. Little training is needed to maintain the thumb sheath 12 in this tight position. The bridge prevents the thumb sheath 12 from swinging outwardly beyond the thumb guard 13 as the conventional glove of FIG. 2*a* demonstrates. The location of the bridge 14 easily trains the fighter to nestle the thumb against the glove body 11 and inside the thumb guard 13 as shown in FIG. 2. The bridge 14 is positioned and attached to prevent the bridge itself from damaging the opponent during a match.

When the fighter constricts his fingers to form a fist, the tips of the fingers lower over the inner panel of the glove body 20 towards the palm. The fingers close over a rib 33 embedded in the inner panel of the glove body 20 for added clenching power. In this clenched position the tip of the thumb sheath 30 rests on the inner surface of the glove body 23. The inner seam 26 of the thumb sheath 17 nestles against the thumb guard 13. The bridge 14 is completely hidden at this point. The thumb sheath 12 does not extend beyond the glove body 11 to cause undue damage to the opponent.

FIG. 5 shows the glove 10 in an open position. The bridge 14 permits free movement of the glove body 11 and limited mobility of the thumb sheath 12. The thumb sheath 12 remains confined against the inner panel of the glove body 20 in this open position.

Before a match and after the fighter's hand is properly bandaged, the boxer loosens the laces 16 of the boxing glove 10. The hand is inserted into the glove through the wrist portion 17 until the fingers are confined in the glove body 11 and the thumb has settled in the thumb sheath 12. The glove is then laced to an acceptable tightness in preparation for the boxing match.

Prior to throwing a punch, the fighter clinches his fist in the traditional manner. In this position as shown in FIG. 2, the thumb sheath 12 nestles against the thumb guard 13 and the glove body 11. Should the blow contact the eye area, the thumb sheath 12 will remain with the glove body 11 and continue past. Consequently, thumbing and gouging of the eye is prevented due to the connecting bridge 14 containing the thumb sheath 12. At no time during a blow will the thumb sheath 12 become so separated from the glove body 11 to do serious damage as caused by the free mobility of the conventional glove. The glove 10 of the present invention permits only limited mobility and trains the boxer to confine and hold his thumb in this inner and safe position.

In a holding or clinching situation, the webbed bridge 14, prevents holding with a completely open glove, a common foul in boxing. Thus, the connecting bridge 14 reduces injuries caused by the free movement of the thumb and also controls the opening and closing of the glove but gives the hand and thumb enough mobility to be highly effective without cramping or numbing.

It is preferred to construct the connecting bridge 14 in a generally rectangular shape, specifically one inch wide and one and one-fourth inches long. The length of the bridge exposed between the two seams 21 and 26 is approximately one half an inch. It has further been preferred to make the bridge 14 of poly-propylene webbing and insert and stitch the bridge 14 into the seam with two rows of nylon thread. Inserting the bridge into the seams strengthens the bridge and makes the glove easier and inexpensive to manufacture.

What is claimed is:

1. A boxing glove having a glove body confining the fingers, said body having a thumb guard adjacent the area of the index finger a thumb sheath, confining the thumb, formed integrally at its base with the glove body and having a tip portion, a connecting bridge connecting the thumb sheath adjacent the tip portion to the thumb guard of the glove body for limiting movement of the thumb sheath relative to the glove body and thereby maintaining the thumb sheath in a tightly closed position, said connecting bridge comprising a woven flexible webbing of generally rectangular configuration and of a width of approximately ½ inch.

* * * * *